United States Patent [19]

Law

[11] Patent Number: 4,834,151

[45] Date of Patent: May 30, 1989

[54] POUR SPOUT

[75] Inventor: Verl Law, Emmett, Id.

[73] Assignee: VEMCO, Emmett, Id.

[21] Appl. No.: 27,014

[22] Filed: Mar. 16, 1987

[51] Int. Cl.[4] ..... B65C 3/00; B65B 39/04

[52] U.S. Cl. ..... 141/198; 141/291; 141/296; 141/302; 141/352; 141/335

[58] Field of Search ..... 141/1-12, 141/37-66, 198-229, 289-310, 39, 192, 351-359, 344, 345, 335

[56] References Cited

U.S. PATENT DOCUMENTS

| | | | |
|---|---|---|---|
| 245,401 | 8/1881 | Raynor et al. | 141/353 |
| 525,744 | 9/1894 | Roth | 141/353 |
| 2,341,950 | 2/1944 | Schepps | 141/387 |
| 2,593,634 | 4/1952 | Vosburg | 222/514 |
| 2,701,078 | 2/1955 | Bowman | 222/117 |
| 3,005,475 | 10/1961 | Beall, Jr. | 141/198 |
| 3,207,190 | 9/1965 | Sibereis et al. | 141/198 |
| 3,263,711 | 8/1966 | Laub | 141/198 X |
| 3,289,712 | 12/1966 | Smith | 141/352 X |
| 3,540,402 | 11/1970 | Kocher | 141/198 |
| 3,595,281 | 7/1971 | Laub, III | 141/198 X |
| 3,994,323 | 11/1976 | Takahata et al. | 141/302 |
| 4,314,657 | 2/1982 | Perakis et al. | 141/305 X |
| 4,598,743 | 7/1986 | Milling | 141/198 X |
| 4,667,710 | 5/1987 | Wu | 141/198 |

FOREIGN PATENT DOCUMENTS

| | | | |
|---|---|---|---|
| 1179560 | 5/1959 | France | 141/335 |
| 368214 | 3/1932 | United Kingdom | 141/335 |
| 1569872 | 6/1980 | United Kingdom | 141/351 |

*Primary Examiner*—Ernest G. Cusick

*Attorney, Agent, or Firm*—Workman, Nydegger & Jensen

[57] ABSTRACT

A fluid conduit attached at one end to a container of fluid is provided at the other end with a fluid discharge opening through which fluid can be transferred into a receiving vessel. A slide valve on the exterior of the conduit is biased into a closed position, precluding any fluid flow from the conduit until the discharge opening is inside the receiving vessel. The slide valve coacts with the receiving vessel to open and permit fluid flow. An air vent tube within the conduit communicates with an air vent opening in the vicinity of the discharge opening. The air vent tube includes one or more capillary sections of reduced inner diameter relative that of the air vent tube. The air bent tube admits air into the container to facilitate fluid flow, while the capillary section limits the rate at which the air enters, thereby reducing the pressure of air in the container below ambient pressure when fluid flows from the conduit. Fluid filling a receiving container closes the air vent opening when filling is completed, terminating air flow into the container and stopping fluid flow through the conduit.

40 Claims, 3 Drawing Sheets

POUR SPOUT

BACKGROUND OF THE INVENTION

1. Field of the Invention

This invention relates to pour spouts for containers of fluid, and more particularly to pour spouts which permit transfers of fluid under the influence of gravity into a receiving vessel without the risk of spillage or overflow.

2. Background Art

The instances are numerous in which a receiving vessel or tank must be filled with a fluid and the environment in which this is accomplished or the nature of the fluid itself demands that spillage be minimized.

A common example involves the widespread use of internal combustion engines in lawnmowers, chainsaws, tractors, motorized recreational vehicles, outboard motors, and other gasoline-powered machinery employed on farms and construction sites. It is undesirable that in filling the fuel reservoirs for such devices gasoline in any appreciable quantity should be spilled. Uncontained gasoline presents health and safety risks to persons nearby, as well as a source of environmental pollution generally. Associated with other fluids, such as cooking or machine oils, pesticides, fertilizers, cleaning fluids, sealants, and even food substances are similar concerns for minimizing spills when fluids are transferred from one container to another.

In such fluid transfers, the opportunity for spills have several causes. First, where the opening into the receiving vessel is narrow, it is often the case that a stream of fluid directed thereinto will, either due to its size or the unsteady hand of the pourer, stray outside of that opening. Where no facilitating pour spout or funnel is employed and the exit of the container of fluid never actually enters the opening to the receiving vessel, this problem is a continuing one throughout the entire pouring process.

Second, containers of fluid, whether or not equipped with facilitating pour spouts or used with funnels, must be tilted toward the receiving vessel in order to initiate a flow of fluid. When this tilting must occur prior to entry of the pour spout into the neck of the receiving vessel or the top of the funnel, spillage is common.

In addition, many spills occur when the receiving vessel to which fluid is being transferred fills and overflows before pouring can be terminated. Such a situation is extremely common in receiving vessels having narrow-necked openings. In such structure, it is difficult for the pourer to visually verify the level of fluid in the receiving container as pouring is occurring. Also, once fluid in the receiving vessel reaches the level of the intake neck of the receiving vessel, additional incoming fluid, rather than being received in the volume of the entire receiving vessel, fills into only in the intake neck thereof. This results in an abrupt increase in the rate of rise in the level of fluid, enhancing the likelihood of an overflow.

A final source of difficulty in controlling transferred fluids to prevent waste and spilling is that frequently the container from which the fluid is being poured is not effectively vented during the pouring process. This can result in an uneven flow of fluid, and even surges of flow which render impossible a reliable prediction of the level of the fluid in the receiving vessel. Surges of fluid flow can also cause splashing. If occurring when the receiving vessel is almost full such surges will certainly cause overflows. In addition, the turbulence created by such surges of flow in the container from which fluid is being poured can shift the weight of that container making it difficult to hold steady.

A further problem related to ineffective venting during pouring is the development of an airlock wherein a total absence of venting in combination with specific volume and viscosity parameters can result in a fluid which will not pour once its container is inverted. On occasion the air lock can be dissipated by righting the container, but such activity causes splashing of the fluid in its container, and the necessity to reenter the pour spout into the receiving vessel thereafter only increase the opportunities for spills.

While a funnel or a narrow-necked pour spout on a fluid container can to a degree reduce spills, such devices without more do not adequately eliminate spills arising due to all of the causes described above. This is particularly true in relation to overflow control in the type of fluid transfers in which fluid flows from a container into a receiving vessel under the influence of gravity exclusively, rather than under circumstances in which pumping motivates motion in the transferred fluid.

The overflow control mechanisms commonly used in service stations for controlling overflow in filling the gas tank of a vehicle are of this latter type. They derive their effectiveness from the fact that the fluid transferred is being moved due to pressure, rather than gravity. By contrast, only gravity is used, for example, to induce the flow of kerosene when that fuel is transferred from a storage container at a campsite into a lantern or a cookstove. It is to such gravity-induced types of fluid transfers that the present invention pertains, and it has been found that prior to this invention, no known satisfactory configuration for a pour spout had been achieved which could consistently facilitate spill-free, clean fluid transfers.

SUMMARY OF THE INVENTION

One object of the present invention is to produce a pour spout for a container of fluid which will preclude the overflow of any receiving vessel into which that fluid is transferred.

Another object of the present invention is to produce such a pour spout which is conducive to a uniform flow of fluid into the receiving vessel, a fluid flow lacking surges which could splash fluid out of the receiving vessel or override the effects of an otherwise operable overflow prevention system.

Still another object of the present invention is to produce a pour spout such as that described above which eliminates spills of the fluid being transferred when the container from which it is to be poured has been inverted, but has not yet been received within the opening to a receiving vessel.

It is yet an additional object of the present invention to make available for the benefit of the public a pour spout as described above which precludes the formation in an upturned container of fluid of any air lock which could interfere with the initiation of fluid flow.

The cumulative purpose of all the above-described objects of the present invention is to produce a pour spout permitting transfers from a container of fluid to a receiving vessel under circumstances which minimize the opportunities for spills or losses of fluid. It is the objective of the present invention to accomplish this in an environment in which the impetus for fluid flow is gravity exclusively.

Additional objects and advantages of the invention will be set forth in the description which follows, and in part will be obvious from the description, or may be learned by the practice of the invention. The objects and advantages of the invention may be realized and obtained by means of the instruments and combinations particularly pointed out in the appended claims.

To achieve the foregoing objects, and in accordance with the invention as embodied and broadly described herein, a pour spout for permitting transfers from a container of fluid to receiving vessel is provided in one embodiment of the invention comprising a fluid conduit attached at one end thereof to the container of fluid. The fluid conduit is provided at a location remote from the container with a fluid discharge opening through which fluid is transferred from the fluid conduit into the receiving vessel. The pour spout further comprises closure means for precluding any flow of fluid from the fluid conduit until the fluid discharge opening is inside the receiving vessel and venting means for admitting air into the interior space within the fluid conduit and the container to facilitate fluid flow from the conduit and for reducing the pressure of air in the interior space to a pressure less than ambient pressure when fluid flows from the fluid conduit. The venting means in addition terminates air flow into the interior space when the receiving container becomes filled with fluid, thereby to effect prompt curtailment of the flow of fluid from the fluid conduit.

Preferably the closure means comprises a slide valve biased into a closed position in which the flow of fluid from the fluid conduit is precluded and a slide valve release means for coacting with the receiving vessel to open the slide valve and permit fluid to flow from the fluid conduit through the fluid discharge opening when the fluid conduit is inserted into the receiving vessel. In one embodiment, the slide valve comprises a sleeve closely conforming to the exterior surface of the fluid conduit and mounted for sliding motion of thereupon; bias means urging the sleeve along the fluid conduit into the closed position of the slide valve in a direction away from the container of fluid; and a valve seat on the fluid conduit on the side of the fluid discharge opening remote from the container of fluid. The sleeve is urged by the bias means into sealing engagement with the valve seat, which may comprise a resilient O-ring encircling the fluid conduit and retained thereat to resist the motion of the sleeve when the sleeve is in the closed position of the slide valve.

In another aspect of the invention, the venting means may preferably comprise an air vent tube communicating between the exterior of the fluid conduit and the interior space within the fluid content and the container of fluid, as well as air flow constriction means for limiting the volume of air passing through the air vent into the interior space to a volume less than the volume of fluid that flows from the fluid conduit. The air flow constriction means may comprise one or more capillary section in the air vent tube which have an inside diameter less than that of the air vent tube. If more than one capillary section is located in the air vent tube, these are separated from each other.

In one embodiment of the inventive pour spout, the air vent tube is disposed within the fluid conduit so as to communicate with an air vent opening formed in the fluid conduit at a position which is inside the receiving vessel when the sleeve is drawn out of sealing engagement with the valve seat by the coaction of the slide valve release means with the receiving vessel. The air vent opening is thereby obstructable by fluid when the receiving container becomes filled therewith. This terminates air flow through the air vent tube into the interior space, causing an abrupt cessation of the flow of fluid through the fluid conduit.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are therefore not to be considered limiting of its scope, the invention will be described with additional specificity in detail through the use of the following drawings in which.

DESCRIPTION OF THE PREFERRED EMBODIMENT

Figure 1:
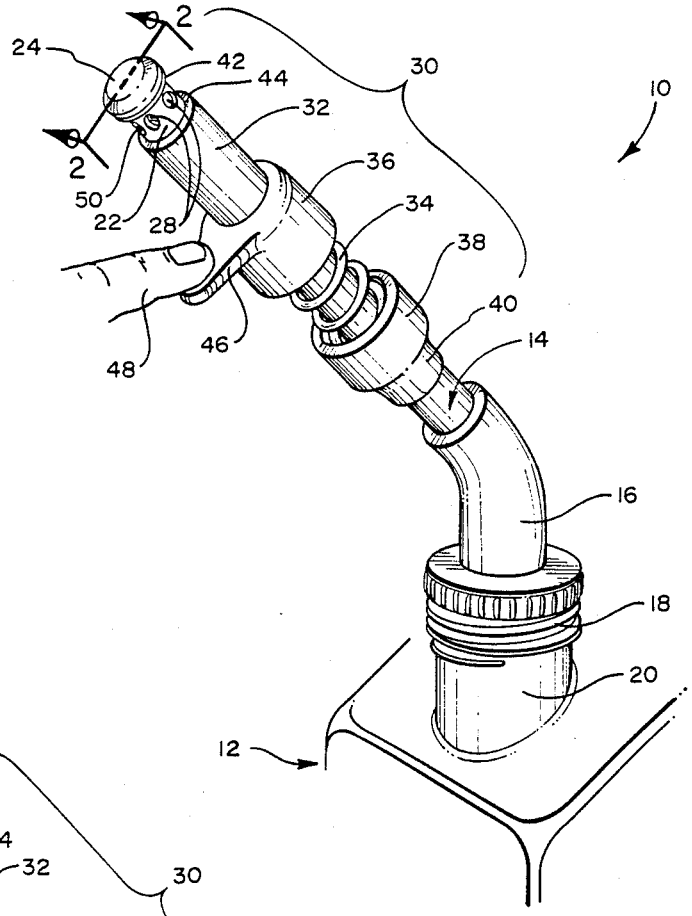
FIG. 1 is a perspective view of one embodiment of a pour spout incorporating the teachings of the present invention.
Figure 2:
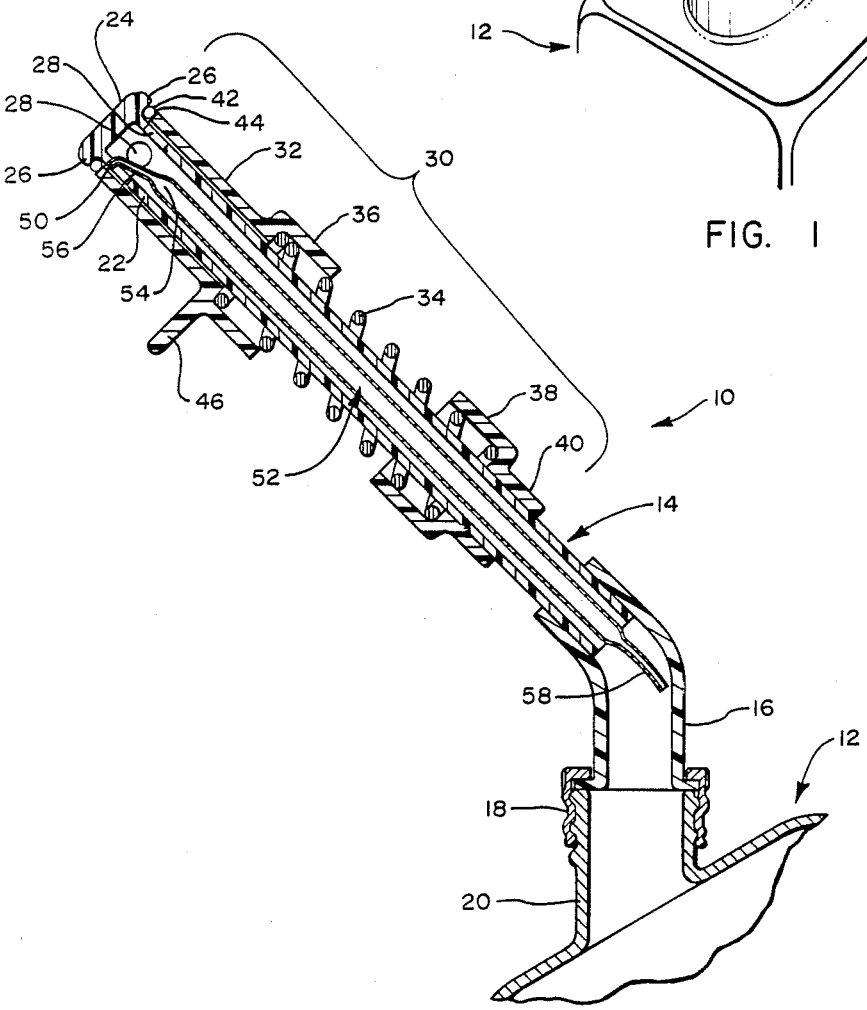
FIG. 2 is a cross-sectional view of the embodiment of the pour spout illustrated in FIG. 1 taken along the section line 2—2 therein.

FIGS. 1 and 2 taken together illustrate one embodiment of a pour spout 10 constructed according to the teachings of the present invention for permitting transfers from a container of fluid 12 while minimizing the possibility of spillage and waste of that fluid. Pour spout 10 comprises a fluid conduit 14 having one end 16 thereof attached to container 12. As used herein, the term "fluid conduit" will be used to refer to any structure, such as fluid conduit 14, through which fluid is transferred from a container, whether or not the fluid conduit is comprised of one or several components, and whether or not the passageway for fluid therethrough is straight, or as in FIGS. 1 and 2 bent at one or more portions thereof.

Pour spout 10 may be fabricated with container 12 as an integral, nonremovable portion thereof by the permanent attachment of end 16 of fluid conduit 14 to container 12. Alternatively, and as shown in FIGS. 1 and 2, pour spout 10 may be removably attached to a container, such as container 12, by any known structure capable of effecting that result. In FIGS. 1 and 2 this is shown to be possible using an annular, threaded cap 18 which cooperates with a correspondingly threaded neck portion 20 of container 12 to retain end 16 of fluid conduit 14 in selectively removable, fluid-sealing engagement therewith.

In pour spout 10 the extreme end 22 of fluid conduit 14 terminates in a laterally disposed endpiece 24 which extends radially outward beyond the exterior of fluid conduit 14 in an overhanging circular lip 26, the function of which will be explained subsequently. At a location on fluid conduit 14 remote from container 12 one or more fluid discharge openings 28 are formed for permitting fluid to exit from fluid conduit 14. In most applications contemplated fluid discharge openings 28 will preferably be located near the extreme end 22 of the fluid conduit in which they are formed.

In accordance with one aspect of the present invention, closure means are provided for precluding any flow of fluid from a fluid conduit, such as fluid conduit 14, until the fluid discharge openings through which such fluid can emerge are inside the receiving vessel to which the fluid is being transferred. As shown in FIGS. 1 and 2 by way of example and not limitation, a slide valve 30 located on conduit 14 is biased into a closed position in which the flow of fluid from fluid conduit 14 through fluid discharge openings 28 is precluded. Slide valve 30 may admit of many alternate configurations, but that presently preferred for the purposes of the inventive pour spout, is shown disposed on the exterior of fluid conduit 14.

Slide valve 30 comprises a sleeve 32 closely conforming to the exterior surface of fluid conduit 14 and mounted for sliding motion thereupon. In a fluid conduit 14 dimensioned so as to have an inner diameter of approximately 0.50 inches, a difference in diameter between the outside of fluid conduit 14 and the inside of the slide valve sleeve 32 which is in the range of 0.002 to 0.003 inches has been found to be a workable clearance satisfying the several functional demands placed upon sleeve 32. Not the least of these demands is that sleeve 32 must slide freely upon fluid conduit 14 and have an adequate longitudinal dimension so as to preclude binding thereupon.

Sleeve 32 is urged along fluid conduit 14 in a direction away from container 12 by a bias means, which by way of illustration, is shown in FIGS. 1 and 2 as a spring 34 disposed encircling fluid conduit 14. Spring 34 is held in compression between an enlarged cylindrical spring retainer 36 at the end of sleeve 32 closest to container 12 and a similarly shaped, opposed spring retainer 38 at the facing end of a collar 40 rigidly attached to fluid conduit 14 at a longitudinally fixed point thereupon. In this manner, spring 34 urges sleeve 32 along fluid comduit 14 in a direction away from container 12. Movement of sleeve 32 off extreme end 22 of fluid conduit 14 is blocked by lip 26 of endpiece 24, which functions as the valve seat for slide valve 30. When sleeve 32 is against lip 26, spring 34 is in its state of longest extension but is still be in a state of relative compression. To enhance the sealing effect of slide valve 30, a resilient O-ring 42 may be retained encircling fluid conduit 14 between lip 26 and fluid discharge openings 28. The leading edge 44 of sleeve 32 then is forced into sealing engagement with O-ring 42 by spring 34 in the closed position of slide valve 30. With slide valve 30 in its closed position, fluid discharge openings 28 are blocked, precluding any flow of fluid from fluid conduit 14 until the biasing effect of spring 34 is overcome.

In accordance with yet another aspect of the invention, the closure means partially described above is further provided with a slide valve release means for coacting with a receiving vessel for fluid from container 12 in order to open slide valve 30 and permit fluid to flow from fluid conduit 14 through fluid discharge openings 28 which are otherwise blocked by the slide valve in its closed position. By way of example, a simple form of such a slide valve release means can be seen in FIGS. 1 and 2 to comprise a projection 46 secured to sleeve 32 for catching the lip of a receiving vessel when pour spout 10 is inserted thereinto. As pour spout 10 is advanced into the receiving vessel, sleeve 32 is drawn out of engagement with its value seat, in this instance with O-ring 42. It is thus the relative motion between a container of fluid, such as container 12, and the inlet to a receiving vessel that serves to open slide valve 30 and permit fluid flow through pour spout 10.

FIG. 1 illustrates the relationship of the parts of pour spout 10 when such relative a motion has overcome the bias of spring 34 and sleeve 32 is no longer in the closed position of slide valve 30. In the instance illustrated in FIG. 1, however, the force upon projection 46 necessary to effect such a result is being applied by a finger 48 of an operator. The same operation is nevertheless effected when end 22 of fluid conduit 14 is moved into a receiving vessel so that projection 46 coacts therewith. Such operation will be described in detail subsequently. In FIG. 2, finger 48 of an operator has been removed from projection 46 and slide 32 can there be seen to be again urged into the closed position of slide valve 30.

In accordance with yet another aspect of the invention, a pour spout, such as pour spout 10, is provided with venting means for admitting air into the interior space within the fluid conduit of the pour spout and the container of fluid with which it is employed to facilitate fluid flow from the fluid conduit. Simultaneously, the venting means of the present invention reduces the pressure of air in that interior space to a pressure less than ambient pressure. In a further significant aspect, the venting means of the present invention terminates the flow of air into that interior space when the receiving container becomes filled with fluid, thereby curtailing the flow of fluid through the pour spout, effecting automatic overflow protection.

By way of illustration, and not limitation, one embodiment of such a venting means for use with a pour spout according to the present invention is best seen in FIG. 2 to comprise an air vent opening 50 formed in fluid conduit 14 and an air vent tube 52 preferably disposed within fluid conduit 14 communicating at one end 54 thereof with air vent opening 50. While air vent tube 52 is shown in FIG. 2 as being entirely disposed within fluid conduit 14, such an arrangement is merely preferred, but not essential, to the satisfactory functioning of the inventive pour spout.

Air vent opening 50 is so located on fluid conduit 14 so as to be within a receiving vessel whenever sleeve 32 is drawn out of sealing engagement with its corresponding valve seat by the coaction of projection 46 with the receiving vessel. Under most circumstances envisioned this would require that air vent opening 50 be in relatively close longitudinal proximity on fluid conduit 14 to fluid discharge openings 28. While such a relative relationship among air fluid discharge openings 28 and vent opening 50 is illustrated in FIGS. 1 and 2, alternate arrangements are workable. For example, air vent opening 50 could be more remote or more proximate to a container of fluid, such as container 12, than are fluid discharge openings 28. The implication of this variable aspect of the invention will become clear when the operation thereof is described below. For the present, however, it suffices to indicate that one function of air vent tube 52 is to admit air into the interior space within fluid conduit 14 and container 12 to facilitate fluid passing out of container 12 through pour spout 10.

The venting means suitable for use with a pour spout, such as pour spout 10, further comprises air flow constriction means for limiting the volume of air passing through an air vent tube, such as air vent tube 52, when fluid flows from the pour spout. The air flow through air vent tube 52 is controlled so that the volume of air passing therethrough is less than the volume of fluid flowing through the pour spout. In this manner, as fluid flows from container 12 through pour spout 10, the pressure of the air in the interior space in container 12 and pour spout 10 is reduced to less than the ambient pressure of the atmosphere outside of container 12. Thus, while the interior space is vented to permit proper, uniform fluid flow through pour spout 10, a back pressure is developed within container 12 which assists in other functions of the venting means.

As shown in FIG. 2, with additional specificity, but by no means by way of limitation, such an air flow constriction means comprises at least one capillary section in air vent tube 52 having an inside diameter less than that of air vent tube 52. In FIG. 2, two such capillary sections 56, 58 are integrally formed in air vent tube 52. Capillary section 56 is located at air vent opening 50, while capillary section 58 is located at the end of air vent tube 52 remote therefrom. For optimum functioning of the air vent means of the present invention in all its diverse aspects, it is desirable that the inside diameter of capillary sections 56, 58 be substantially identical. Capillary sections 56, 58 need not, however, be of equal length to ensure optimum functioning of the device. While capillary sections 56, 58 are shown in FIG. 2 as separated from each other, a suitable air flow constriction means is conceivable for specific combinations of fluid viscosity and lengths of an air vent tube as would require the capillary portions to encompass the entire length of the air vent tube.

Figure 3A:
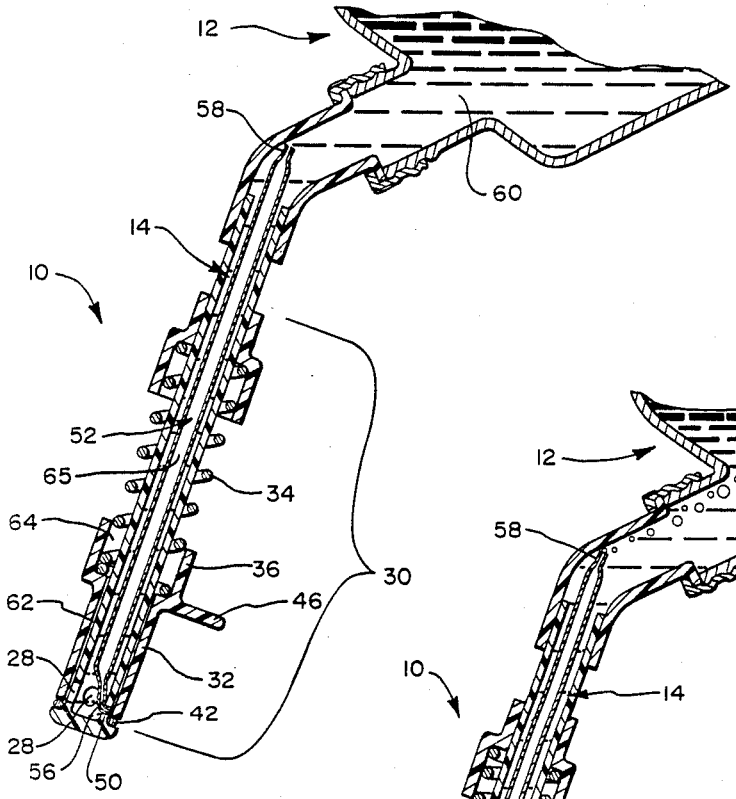
FIG. 3A is a cross-sectional view of the pour spout shown in FIG. 1 in a first stage of operation.

The operation of a pour spout according to the present invention, such as pour spout 10, will now be described in detail in relation to FIGS. 3A, 3B, and 3C in sequence. In FIG. 3A, container 12 holding a reservoir of fluid 60 has been upturned in preparation for transferring a portion of fluid 60 into a receiving vessel. Fluid 60 thus fills the portion of fluid conduit 14 exterior to air vent tube 52. Due to the action of spring 34, sleeve 32 is in the closed position of slide valve 30 urged against O-ring 42, and fluid 60 is in theory precluded from escaping through fluid discharge openings 28 by the inner surface of sleeve 32.

In such fact, however, unless the fit between sleeve 32 and fluid conduit 14 is exact, a condition which could be predicted to preclude easy sliding of sleeve 32 on fluid conduit 14, fluid does seep through fluid discharge openings 28 into the interstitial space 62 between sleeve 32 and the outer surface of fluid conduit 14. The seepage of fluid 60, is nevertheless sufficiently slow due to the close fit between sleeve 32 and the outer surface of fluid conduit 14 as to adequately serve the purposes of the inventive pour spout. For the clearances described already, inverted positioning, such as that shown in FIG. 3A, for a period of approximately thirty seconds would be required until seepage of fluid 60 filled all of interstitial space 62, as well as the cup-like space 64 within spring retainer 36. By that point in time, however, further operation of pour spout 10 will normally have occured, eliminating any fluid 60 within interstitial space 62. In addition to permitting sleeve 32 to slide upon fluid conduit 14, interstitial space 62 permits venting of container 12 when stored in its upright position, thereby preventing an dangerous buildup of pressure therewithin.

When container 12 is inverted, the flow of fluid 60 within fluid conduit 14 down the outside of air vent tube 52 is quicker than it would be within air vent tube 52. This is partially a result of capillary section 58 at the end of air vent tube 52 remote from air vent opening 50. Capillary section 58 slows the exchange of air entrapped in air tube 52 for fluid 60 when container 12 is inverted. Less obviously, if air vent opening 50 is located relatively close to the end of fluid conduit 14, then fluid 60 seeping through fluid discharge openings 28 into interstitial space 62 will promptly enter air vent opening 50 and fill capillary section 56 of end 54 of air vent tube 52. This will prevent any air entrapped in air vent tube 52 when container 12 is inverted from escaping through air vent opening 50. The fluid head at the open end of capillary section 58 present due to the reservoir of fluid 60 housed in container 12 in combination with the reduced inner diameter of capillary section 58 will prevent the escape of air from air vent tube 52 through the end thereof remote from air vent opening 50. The result will be a static condition in which an air column 65 is trapped in air vent tube 52 awaiting the next phase of pour spout operation.

The effect of column 65 trapped in air vent tube 52 is critical in two respects to ensuring the prompt flow of fluid during the next stage of operation, when slide 32 is retracted by the coaction of projection 46 with the opening to the receiving vessel for fluid 60. First, column 65 trapped in air vent tube 52 prevents air vent tube from filling up with fluid 60, which would seriously undermine the abiility air vent tube 52 to admit air into the interior space within fluid conduit 14 and container 12. Were air vent tube 52 filled with fluid 60 like the rest of fluid conduit 14, the fluid head pressure at air vent opening 52 due to the reservoir of fluid 60 thereabove in container 12 would be equal to the fluid head pressure at fluid discharge openings 28. With no differential in head pressure between the fluid discharge openings 28 and the air vent opening 50, no air could enter container 12 to relieve back pressure on fluid 60 even with sleeve 32 retracted. Fluid 60 would not flow, or if it did so, flow would commence on an unpredictable basis.

Most individuals are familiar with the phenomenon in which an upturned full bottle of catsup will not permit its contents to emerge. Those contents are normally freed either by shaking the bottle, which imparts to the contents thereof adequate momentum to overcome the back pressure created in the top of the bottle by their escape, or by venting the top of the bottle so that air may be exchanged volume-for-volume by any catsup that does pour out. The latter is usually accomplished by tilting back the bottle to one side to permit an air passageway to the interior of the bottle to develop along the upper surface of the neck of the bottle. Under circumstances contemplated for fluid transfers with the inventive pour spout, however, neither shaking nor back tilting are considered acceptable means for initiating the flow of fluid.

The contents of a bottle of catsup which cannot be extracted due to an air lock condition such as that described above, could alternatively be made to flow, if a thin venting tube were extended through the mouth of the inverted bottle and the catsup to the air space within the bottle thereabove. Nevertheless, were this venting tube to fill with catsup, it would still not provide the venting action required to initiate catsup flow, even with the distal end of that tube in the airspace in the top of the bottle. The fluid head in the filled venting tube and outside it in the filled bottle neck would be equal. Only a differential between the fluid pressure at the open end of the bottle and the exposed end of the venting tube could commence the flow of catsup. Suction or air pressure at one or the other of these two locations would be required to overcome the static condition of the fluid. Otherwise, the user would merely have to be content to wait until some shift in the fluid stasis were to occur, breaking the air lock in the bottle.

In the inventive pour spout, by contrast, air column 65 trapped in air vent tube 52 prevents such venting dysfunctions. The air column 65 creates a head pressure differential between fluid discharge openings 28 and air vent opening 50 due to the difference in head pressure created by air column 65 and the corresponding column of fluid 60 in fluid conduit 14 outside air vent tube 52. The head pressure at fluid discharge openings 28 in the static position depicted in FIG. 3A is that arising due to the full height of the fluid 60 standing above fluid discharge openings 28. On the other hand, the head pressure at air vent opening 50 is in substance equal only to the head pressure developed by the amount of fluid 60 standing above capillary section 58 at the end of air vent tube 52 remote from air vent opening 50.

This is because within air vent tube 52, between capillary section 58 and capillary section 56, no column of fluid 60 is present. Air column 65 adds a negligible amount of head pressure to that exerted on the small quantity of fluid closing capillary section 54 at air vent opening 50. Thus, the head pressure at capillary section 52 is equal to that exerted at capillary section 58, which is transmitted thereto through the compressible air column 65. As the head pressure in fluid 60 at capillary section 58 will always be less than head pressure appearing at fluid discharge openings 28 at the far end of fluid conduit 14, the opening of slide valve 30 will result in fluid flow, promptly, consistently, and continuously through fluid discharge openings 28, while air is drawn inward through air vent tube 52 into the space in container 12 above fluid 60.

Figure 3B:
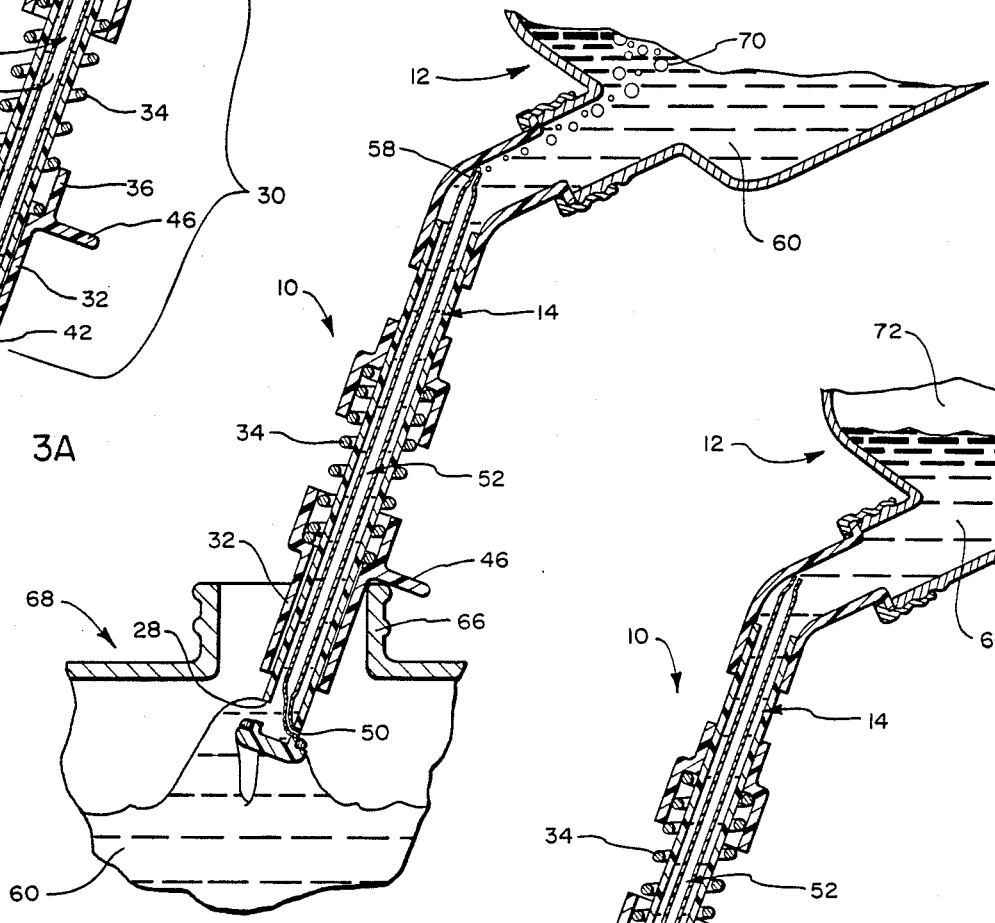
FIG. 3B is a cross-sectional view of the pour spout of FIG. 1 shown in a second stage of operation.

This dynamic state is depicted in FIG. 3B. There, projection 46 secured to sleeve 32 has engaged lip 66 of the opening to a receiving vessel 68 for fluid 60. As container 12 and pour spout 10 attached thereto are further advanced into receiving vessel 68, relative motion between sleeve 32 and fluid conduit 14 occurs, overcoming the bias of spring 34. In this process, it is normally adequate for the operator to merely rest pour spout 10 within receiving vessel 68 so that projection 46 engages lip 66 and then to permit the cumulative weight of container 12 with fluid 60 therein to descend compressing spring 34.

Support of the weight of container 12 in this manner would, however, suggest that pour spout 10, or at least fluid conduit 14 and slide 32 thereof, be made of a relatively sturdy material capable of bearing weight of such a magnitude. In instances where the use of pour spout 10 is contemplated with flammable fluids, a non-ferrous material, such as copper or sturdy plastic, is further recommended so as not to cause fluid-igniting sparks should pour spout 10 be struck accidentally against concrete or a ferrous material.

In any case, once sleeve 32 has been drawn toward container 12 exposing fluid discharge openings 28, fluid 60 will flow through these into receiving vessel 68, while air is drawn through air vent tube 52 into container 12, as indicated by bubbles 70 emerging from capillary section 58 of air vent tube 52. In this position of slide 32, any fluid 60 which seeped through fluid discharge openings 28 into interstitial space 62 or space 64 within spring retainer 36 will drain way into receiving vessel 68.

While air vent tube 52 does admit air into container 12, the presence of one or more capillary sections, such as capillary sections 56, 58, therein, constricts that flow of air so that the volume of air passing through air vent tube 52 is less than the volume of fluid 60 that flows from fluid conduit 14 through fluid discharge openings 28. For this purpose and for the purpose of properly entrapping the bubble of air in air vent tube 52 when fluid container 12 is upturned, it has been found that the inner diameter of air vent tube 52 should be at least 1.5 times, and preferably at least 2.0 times, the inner diameter of any capillary sections therein, such as capillary sections 56, 58. In a pour spout having a fluid conduit 14 with an inner diameter of 0.50 inches and five fluid discharge openings 28 each having an inner diameter of 0.218 inches, capillary sections, such as capillary sections 56, 58, having inner diameters of 0.070 inches have proved entirely satisfactory when used with a container 12 holding gasoline.

The purpose of admitting a lesser volume of air through air vent tube 52 than the volume of fluid 60 emerging from fluid conduit 14 is to create in container 12 above the reservoir of fluid 60 an area of reduced air pressure. This tends to keep to a controllable rate the volume of fluid 60 entering a receiving vessel, but it also affords enhanced responsiveness in shutting off that flow when receiving vessel 68 becomes filled. When air flow through air vent tube 52 is terminated, the vacuum above the reservoir of fluid 60 causes fluid flow through fluid discharge openings 28 to cease almost simultaneously. No delay or passage of fluid out of conduit 14 is required in order to generate the back pressure above fluid 60 with which to terminate its flow. This back pressure is present with the pour spout of the present invention, even in the dynamic pouring state.

Figure 3C:
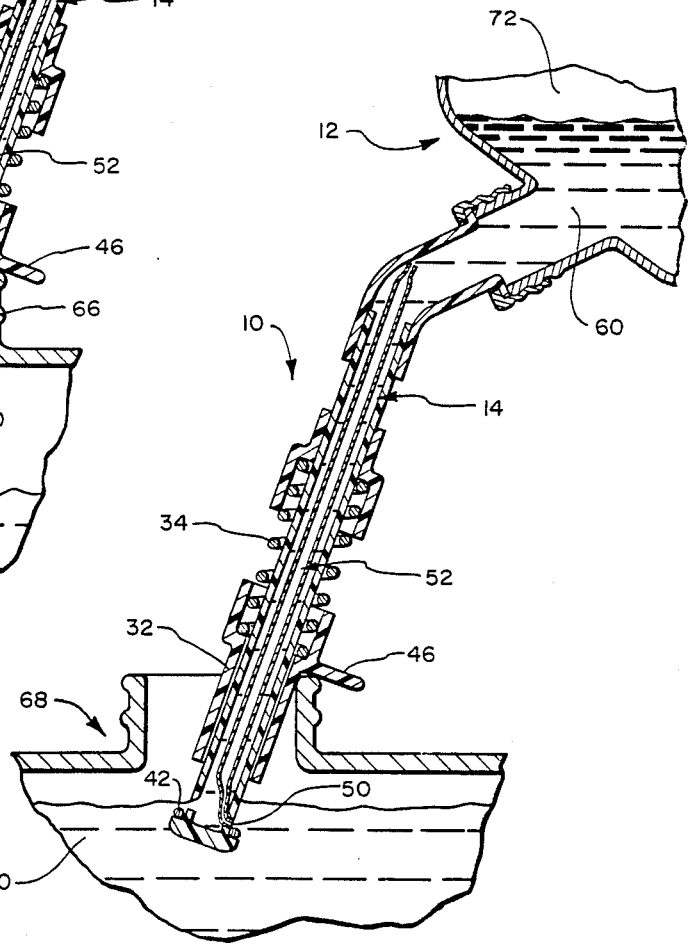
FIG. 3C is a cross-sectional view of the pour spout of FIG. 1 shown in a third and final stage of operation.

The stoppage of fluid flow is depicted in FIG. 3C. There, the level of fluid 60 in receiving vessel 68 has risen, due to the transfer of fluid 60, to a point at which fluid 60 obstructs air vent opening 50, thereby terminating air flow through vent tube 52 into the interior of container 12. The partial vacuum in space 72 above fluid 60 in container 12 exerts back pressure upon the further flow of fluid 60 from fluid conduit 14, and a condition of fluid stasis again results.

The operator of a pour spout, such as pour spout 10, need not peer into the opening into receiving vessel 68 or anxiously await the overflow of fluid 60 therefrom. Instead, after inserting pour spout 10 into receiving vessel 68, the operator can be secure in the knowledge that when receiving vessel 68 has filled with fluid 60 to the point that air vent opening 50 at the end of pour spout 10 is covered by fluid 60, all flow will stop. Thereafter, lifting of container 12 will remove pour spout 10 from receiving vessel 68, and the bias of spring 34 will return sleeve 32 into sealing engagement with O-ring 42. This thereafter prevents any loss of fluid from fluid discharge openings 28 during the time that container 12 is being returned to the upright.

Thus, the venting means of the present invention is one that not only admits air into the interior space within the container from which fluid is being dispensed while simultaneously developing a negative pressure thereabove, but the venting means also terminates air flow into the interior space when the receiving container for that fluid becomes filled. This effects a prompt curtailment of fluid flow through the fluid conduit into the receiving vessel. This overflow protection keeps excess fluid from emerging as overflow out of the receiving container.

The operation of an air vent tube, such as air vent tube 52, in conjunction with at least one capillary section, such as capillary sections 56 or 58, is so advantageous in permitting effective venting of a container of fluid and in preventing overflow when fluid is transferred from that container into a receiving vessel, that it is envisioned that such an air vent tube will have utility in pour spouts, aside from the inclusion therein of any slide valve, such as slide valve 30. Under such circumstances, it would only be necessary that such an air vent tube would communicate between the space exterior fluid conduit 14 at a location adjacent fluid discharge openings 28 and the interior space within container 12. Satisfactory venting and a limited form of overflow protection would then be available, provided that the end of fluid conduit 14 were located within the receiving vessel during the transfer of fluid and withdrawn therefrom in a quick motion simultaneously upturning container 12 once flow from container 12 had terminated. While a device of this type would not provide the complete spill protection afforded in pour spout 10 with slide valve 30, it would nevertheless be an improvement over some existing pour spout devices and is accordingly considered to be part of the inventive pour spout. In such a configuration, air vent tube 52 could for a substantial portion of its length also be located on the exterior of fluid conduit 14.

Figure 4:
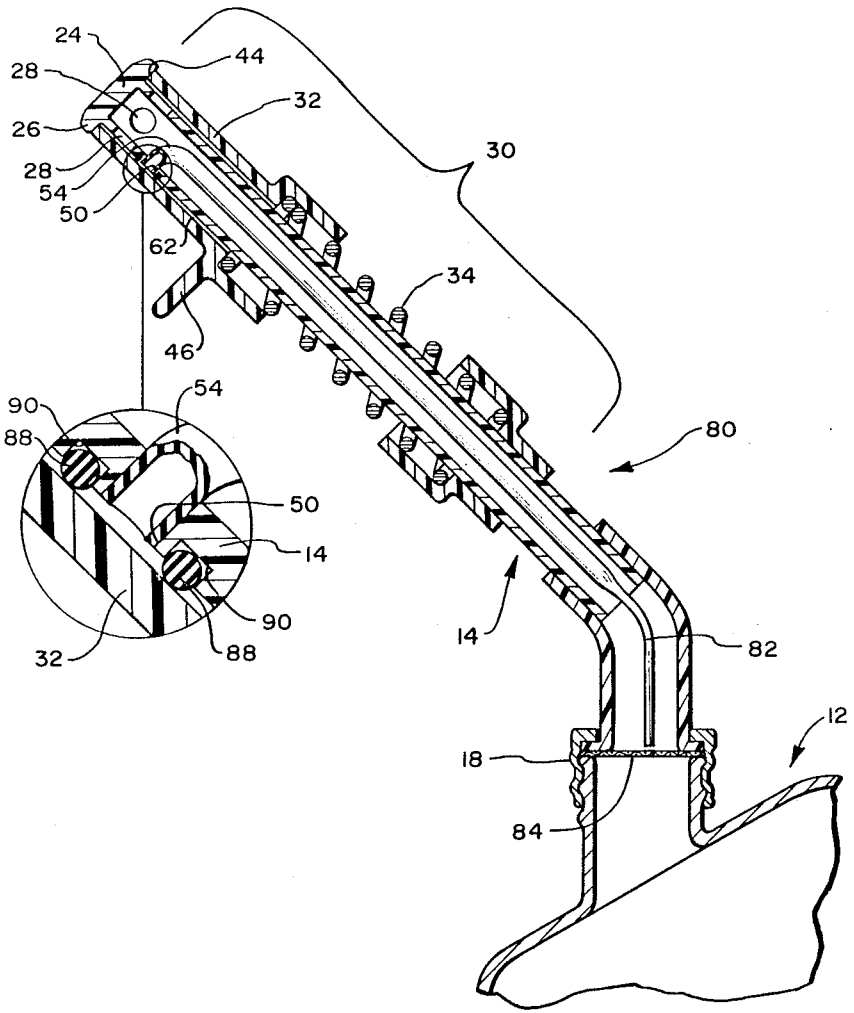
FIG. 4 is a cross-sectional view of a second embodiment of a pour spout embodying teachings of the present invention.

FIG. 4 depicts yet another embodiment of a pour spout 80 constructed according to the teachings of the present invention. Only the manner in which the structure of pour spout 80 distinguishes from that of pour spout 10 will be discussed, and identical structures will continue to be identified by the reference characters used in relation to the device of FIGS. 1 and 2. Pour spout 80 is shown removably attached to a container of fluid 12.

In contrast to pour spout 10, the leading edge 44 of sleeve 32 seats directly against lip 26 of endpiece 24, which functions as the valve seat of slide valve 30. Also, air vent opening 50 is located closer to container 12 than are fluid discharge openings 28. This will have the effect of permitting fluid transferred into a receiving vessel to fill the receiving vessel higher in the neck of the opening thereinto than would a pour spout, such as pour spout 10, in which air vent opening 50 and fluid discharge openings 28 are at approximately the same longitudinal location on fluid conduit 14. In addition, air vent tube 52 in pour spout 80 is provided with only one capillary section 82, which while longer than corresponding capillary section 58 in FIG. 2, is still contained within the body of fluid conduit 14. The attachment of pour spout 80 to container 12 has been enhanced by the addition of a flash screen 84 to prevent entry of debris that might obstruct the proper functioning of capillary section 82.

As illustrated in FIG. 4, the end 54 of air vent tube 52 at air vent opening 50 does not narrow into a capillary section. Therefore, the fluid seal which develops in pour spout 10 at capillary section 56 when fluid container 12 is upturned to prevent the escape of air from fluid container 52, is not available in pour spout 80. In many instances, if the size of capillary section 82 is adequately small, this will not be a problem, as fluid seeping through fluid discharge openings 28 into interstitial space 62 between sleeve 32 and fluid conduit 14 will nonetheless fill air vent tube 52 at air vent opening 50 in due course, stopping the escape of air in that direction.

Even if a fluid seal at air vent opening 50 is effected, an air column in air vent tube 52 will not be securely entrapped, because the difference in internal cross section between end 54 of air vent tube 52 and capillary section 82 does not produce stasis. Rather, the pneumatic advantage created by those differing cross sections will gradually migrate the bubble of air in air vent tube 52 upward therein and possibly entirely out of capillary Section 82. In theory, this process should only proceed to such a height as fluid 60 can rise in interstitial space 62 and space 66 within spring retainer 36.

Nevertheless, to prevent this, and to provide pour spout 80 with the full range of functional features found in pour spout 10, a mechanical, air tight seal may be provided at air vent opening 50 that closes air vent opening 50 at a point prior to or when sleeve 32 engages the valve seat of slide valve 30. Such an air tight seal could take the form of a resilient O-ring 86 retained in a groove 88 on the outer surface of fluid conduit 14 encircling air vent opening 50, as is illustrated in the detail to FIG. 4.

Figure 5:
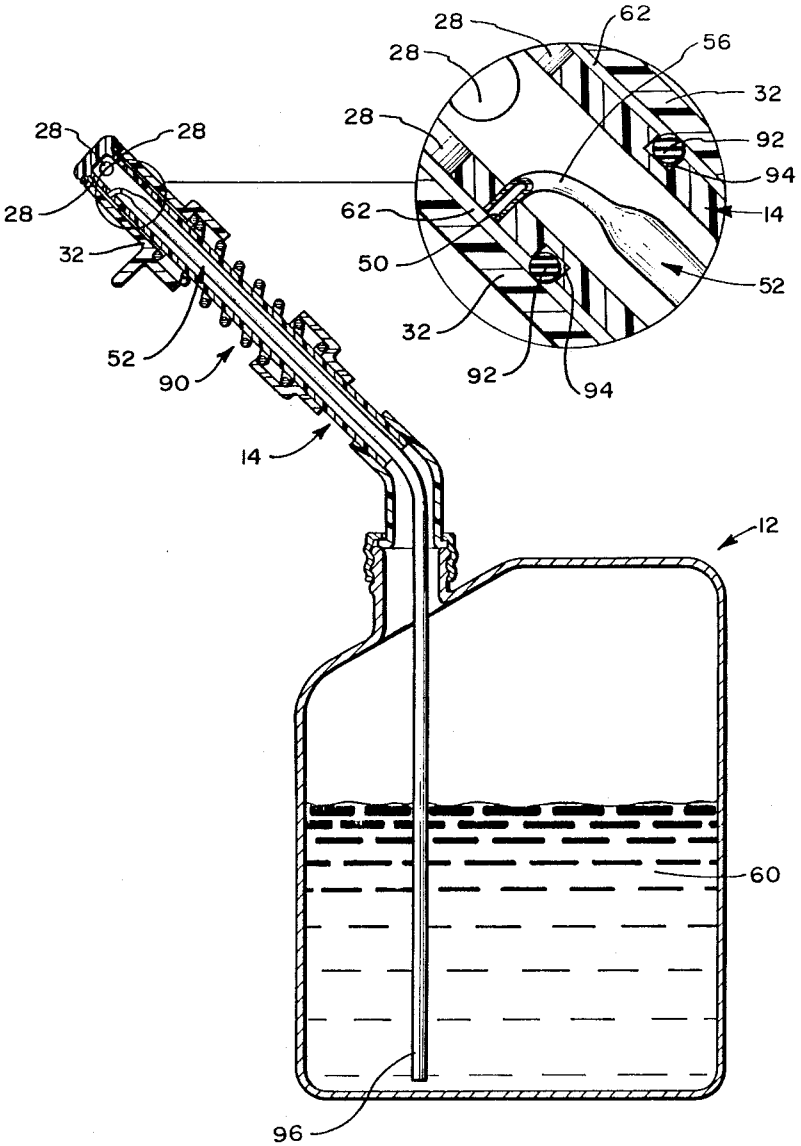
FIG. 5 is a cross-sectional view of a fluid container having attached thereto a third embodiment of a pour spout incorporating teachings of the present invention.

Yet another embodiment of a pour spout 90 embodying teachings of the present invention is shown in FIG. 5 attached to a container 12 for fluid 60. Again, only the manner in which the structure of pour spout 90 differs from that of pour spout 10 will be discussed in any detail, and the structure of pour spout 90 identical to that of pour spout 10 will be referred to by correspondingly identical reference numerals.

As described earlier, when a container 12 using a pour spout according to the present invention is inverted, as in FIG. 3A, fluid 60 from within container 12 slowly seeps through fluid discharge openings 28 into the interstitial space 62 between sleeve 32 and fluid conduit 14, shown in the detail to FIG. 5. The possibility of fluid 60 in this manner ultimately escaping pour spout 90 can be entirely prevented by the provision of an auxiliary seal between sleeve 32 and the exterior surface of fluid conduit 14. Such an auxiliary seal can take the form of a resilient O-ring 92 retained in a groove 94 encircling fluid conduit 14 on the side of fluid discharge openings 28 and air vent opening 50 adjacent container 12. Such a sealed pour spout 90 would have the additional advantage of not venting container 12 were container 12 to be stored indoors containing a fluid 60 emitting objectionable vapors.

Air vent tube 52 is provided with a single capillary section 56 which is located at air vent opening 50 in the manner shown in FIG. 1. The end 96 of air vent tube 52 remote from air vent opening 50 does not contain any capillary section. This can be compensated for to a degree, if air vent tube 52 is extended beyond fluid conduit 14 into close proximity with the bottom 98 of container 12. Under most circumstances, when container 12 is inverted, end 96 of air vent tube 52 will be above the surface of fluid 60, and air vent tube 52 will function adequately to vent the interior space of container 12 when fluid is flowing out of fluid conduit 14. By virtue of capillary section 56 an area of reduced pressure will yet be developed in container 12 relative the ambient pressure outside it.

A possibility for dysfunction exists, however. As end 96 of air vent tube 52 extends into fluid 60 when container 12 is upright, a certain quantity of fluid 60 will be trapped in air vent tube 52 when the assembly of container 12 and pour spout 80 is inverted. If this quantity of fluid fills air vent tube 52 to precisely the height of the surface of fluid 60 in container 12 in that inverted position, then the head pressure, both at fluid discharge openings 28 and at air vent opening 50, will be equal and air lock and delayed initiation of flow will result. Despite such disadvantageous functioning, pour spout 90 in other respects is adequately advantageous over known pour spouts, that the configuration shown in FIG. 5 is nevertheless considered to be within the scope of the inventive pour spout disclosed.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A pour spout for permitting transfers from a container of fluid to a receiving vessel, the pour spout comprising:

(a) a fluid conduit attached at one end thereof to the container of fluid, said fluid conduit being provided at a location remote from the container with a fluid discharge opening through which fluid is transferred from said fluid conduit into the receiving vessel;

(b) closure means for precluding any flow of fluid from said fluid conduit until said fluid discharge opening is inside the receiving vessel; and (c) venting means for admitting air into the interior space within said fluid conduit and the container to facilitate fluid flow from said fluid conduit and for reducing the pressure of air in said interior space to a pressure less than ambient pressure when fluid flows from said fluid conduit, said venting means terminating air flow into said interior space when the receiving vessel becomes filled with fluid thereby to effect prompt curtailment of fluid flow from said fluid conduit, said venting means comprising:

(i) an air vent tube communicating between the exterior of said fluid conduit at a location which is inside the receiving vessel when said closure means ceases to preclude flow of fluid from said fluid conduit; and (ii) a capillary section located in said air vent tube having an inside diameter less than that of said air vent tube.

2. A pour spout as recited in claim 1, wherein said closure means comprises:

(a) a slide valve having a closed position in which the flow of fluid from said fluid conduit is precluded, said slide valve being biased into said closed position; and (b) slide valve release means for coacting with the receiving vessel to open said slide valve and permit fluid to flow from said fluid conduit through said fluid discharge opening when said fluid conduit is inserted into the receiving vessel.

3. A pour spout as recited in claim 2, wherein said slide valve comprises:

(a) a sleeve closely conforming to the exterior surface of said fluid conduit and mounted for sliding motion thereupon;

(b) bias means urging said sleeve along said fluid conduit in a direction away from the container of fluid; and (c) a valve seat on said fluid conduit on the side of said fluid discharge opening remote from the container of fluid, said sleeve being urged by said bias means into sealing engagement with said valve seat in said closed position of said slide valve.

4. A pour spout as recited in claim 3, wherein said valve seat comprises:

(a) a lip radially projecting from said conduit on the side of said fluid discharge opening opposite from the container; and (b) a resilient O-ring encircling said fluid conduit between said lip and said fluid discharge opening, said O-ring being compressed between said lip and said sleeve when said sleeve is in said closed position of said slide valve.

5. A pour spout as recited in claim 3, wherein said slide valve release means comprises a projection secured to said sleeve for catching the lip of the receiving vessel and drawing said sleeve out of sealing engagement with said valve seat as said fluid conduit is extended into the receiving vessel.

6. A pour spout as recited in claim 3, wherein said closure means further comprises an auxiliary seal between said sleeve and said exterior surface of said conduit, said auxiliary seal encircling said fluid conduit on the side of said fluid discharge opening adjacent said container of fluid.

7. A pour spout as recited in claim 3, wherein said bias means comprises a spring.

8. A pour spout as recited in claim 7, wherein said spring is in compression when said sleeve is in sealing engagement with said valve seat.

9. A pour spout as recited in claim 8, wherein said spring is disposed encircling said fluid conduit retained in compression between said sleeve and a longitudinally fixed point on said fluid conduit.

10. A pour spout for permitting transfers from a container of fluid to a receiving vessel, the pour spout comprising:

(a) a fluid conduit attached at one end thereof to the container of fluid, said fluid conduit being provided at a location remote from the fluid container with a fluid discharge opening through which fluid from the container of fluid is transferred from the fluid conduit into the receiving vessel;

(b) a sleeve closely conforming to the exterior surface of said fluid conduit and mounted for sliding motion thereupon;

(c) bias means urging said sleeve along said fluid conduit in a direction away from the container of fluid;

(d) a valve seat on said fluid conduit on the side of said fluid discharge opening opposite from the container of fluid, said sleeve being urged by said bias means into sealing engagement with said valve seat to preclude any flow of fluid from said fluid conduit until said fluid discharge opening is inside the receiving vessel;

(e) a projection secured to said sleeve for coacting with the receiving vessel to overcome said bias means and draw said sleeve out of sealing enagement with said valve seat as said fluid conduit is extended into the receiving vessel; and (f) venting means for admitting air into the interior space within said fluid conduit and said container of fluid to facilitate fluid flow from said fluid conduit and for reducing the pressure of air in said interior space to a pressure less than ambient pressure when fluid flows from said fluid conduit, said venting means terminating air flow into said interior space when the receiving container becomes filled with fluid, thereby to effect prompt curtailment of fluid flow from said fluid conduit said venting means comprising:

(i) an air vent tube communicating between the exterior of said fluid conduit and said interior space; and (ii) at least one capillary section in said air vent tube having an inside diameter less than that of the air vent tube.

11. A pour spout as recited in claim 10, wherein said venting means further comprises an air vent opening formed in said fluid conduit and wherein said air vent tube is disposed within said fluid conduit communicating at one end thereof with said air vent opening.

12. A pour spout as recited in claim 11, wherein said air vent opening is formed in said fluid conduit at a location therein which is inside the receiving vessel when said sleeve is drawn out of sealing engagement with said valve seat by the coaction of said projection with the receiving vessel, said air vent opening being thereby obstructable by fluid when the receiving container fills with fluid, thereby terminating air flow through said air vent tube into said interior space.

13. A pour spout as recited in claim 12, wherein the full length of said air vent tube is disposed within said fluid conduit.

14. A pour spout as recited in claim 13, wherein said air vent opening is formed in said fluid conduit at a location thereof which is longitudinally proximate said fluid discharge opening.

15. A pour spout as recited in claim 14, wherein said at least one capillary section is located at the end of said air vent tube remote from said air vent opening.

16. A pour spout as recited in claim 15, further comprising an air tight seal at said air vent opening for closing said air vent opening when said sleeve engages said valve seat.

17. A pour spout as recited in claim 14, wherein said venting means comprises two capillary sections located in said air vent tube separated from each other.

18. A pour spout as recited in claim 17, wherein a first one of said two capillary sections is located at said air vent opening.

19. A pour spout as recited in claim 18, wherein a second one of said two capillary sections is located at the end of said air vent tube remote from said air vent opening.

20. A pour spout as recited in claim 12, wherein said air vent tube extends beyond said fluid conduit into the container of fluid.

21. A pour spout as recited in claim 20, wherein said air vent opening is located longitudinally proximate said fluid discharge opening.

22. A pour spout as recited in claim 21, wherein said venting means comprises two capillary sections located in said air vent tube separated from each other.

23. A pour spout as recited in claim 22, wherein a first one of said two capillary sections is located at said air vent opening.

24. A pour spout as recited in claim 23, wherein a second one of said two capillary sections is located at the end of said air vent tube remote from said air vent opening.

25. A pour spout as recited in claim 21, wherein said at least one capillary section is located at said air vent opening.

26. A pour spout as recited in claim 25, further comprising an air tight seal at said air vent opening for closing said air vent opening when said sleeve engages said valve seat.

27. A pour spout as recited in claim 10, wherein said at least one capillary section is integrally formed with said air vent tube.

28. A pour spout as recited in claim 10, wherein the inside diameter of said air vent tube is greater than or equal to 1.5 times the inside diameter of said at least one capillary section.

29. A pour spout as recited in claim 28, wherein the inside diameter of said air vent tube is greater than or equal to two times the inside diameter of said at least one capillary section.

30. A pour spout as recited in claim 10, wherein said fluid conduit is selectively removably attached to the container of fluid.

31. A pour spout as recited in claim 10, wherein said fluid conduit and said sleeve are made of a non-ferrous material.

32. A pour spout for permitting transfers from a container of fluid to a receiving vessel, the pour spout comprising:

(a) a fluid conduit attached at one end thereof to the container of fluid, said fluid conduit being provided at a location remote from the container with a fluid discharge opening through which fluid is transferred from said fluid conduit into the receiving vessel;

(b) closure means for precluding any flow of fluid from said fluid conduit until said fluid discharge opening is inside the receiving vessel;

(c) an air vent opening formed in said fluid conduit at a location therein which is inside the receiving vessel when said closure means ceases to preclude flow of fluid from said fluid conduit;

(d) an air vent tube disposed within said fluid conduit communicating at one end thereof with said air vent opening so as to communicate between the exterior of said fluid conduit and the interior space within said fluid conduit and said container of fluid, said air vent tube admitting air into said interior space to facilitate fluid flow from said fluid conduit; and (e) air flow constriction means for limiting the volume of air passing through said air vent tube into said interior space to a volume less than the volume of fluid that flows from said fluid conduit, said air flow constriction means comprising two capillary sections located in said air vent tube, separated from each other, and having of inside diameters less than the inside diameter of said air vent tube.

33. A pour spout as recited in claim 32, wherein a first one of said two capillary sections is located at said air vent opening.

34. A pour spout as recited in claim 33, wherein a second one of said two capillary sections is located at the end of said air vent tube remote from said air vent opening.

35. A pour spout as recited in claim 34, wherein the inside diameter of said two capillary sections are substantially equal.

36. A pour spout as recited in claim 35, wherein the inside diameter of said air vent tube is greater than or equal to two times the inside diameter of said capillary sections.

37. In a pour spout for permitting transfers from a container of fluid to a receiving vessel, the combination comprising:

(a) a fluid conduit attached at one end thereof to the container of fluid, said fluid conduit being provided at a location remote from the container with a fluid discharge opening through which fluid is transferred from said fluid conduit into the receiving vessel;

(b) an air vent tube communicating between the exterior of said fluid conduit at a point proximate said fluid discharge opening and the interior space within said fluid conduit and said container of fluid, said air vent tube admitting air into said interior space to facilitate fluid flow from said fluid conduit; and (c) air flow constriction means for limiting the volume of air passing through said air vent tube into said interior space to a volume less than the volume of fluid that flows from said fluid conduit, wherein said air flow constriction means comprises at least one capillary section located in said air vent tube and having an inside diameter less than that of said air vent tube.

38. A pour spout as recited in claim 37, wherein the inside diameter of said air vent tube is greater than or equal to two times the inside diameter of said at least one capillary section.

39. A pour spout for permitting transfers from a container of fluid to a receiving vessel, the pour spout comprising:

(a) a fluid conduit attached at one end thereof to the container of fluid, said fluid conduit being provided at a location remote from the fluid container with at least one fluid discharge opening through which fluid from the container of fluid is transferred from the fluid conduit into the receiving vessel;

(b) a sleeve closely conforming to the exterior surface of said fluid conduit and mounted for sliding motion thereupon;

(c) a spring disposed encircling said fluid conduit in compression between said sleeve and a longitudinally fixed point on said fluid conduit, said spring urging said sleeve along said fluid conduit in a direction away from the container of fluid;

(d) a resilient O-ring encircling said fluid conduit on the side of said fluid discharge opening remote from the container of fluid, said sleeve being urged by said spring into sealing engagement with said O-ring;

(e) a projection secured to said sleeve for catching the lip of the receiving vessel and drawing said sleeve out of sealing engagement with said O-ring as said fluid conduit is extended into the receiving vessel;

(f) an air vent opening formed in said fluid conduit at a location thereon which is inside the receiving vessel when said sleeve is drawn out of sealing engagement with said valve seat by the coaction of said projection with the receiving vessel, said air vent opening being thereby obstructable by fluid when the receiving container fills therewith;

(g) an air vent tube disposed within said fluid conduit communicating at one end thereof with said air vent opening, said air vent tube admitting air into the interior space within said fluid conduit and said container of fluid to facilitate fulid flow from said fluid conduit; and (h) two capillary sections in said air vent tube, said two capillary sections having substantially equal inside diameters less than that of said air vent tube for limiting the volume of air passing through said air vent tube into said interior space to a volume less than the volume of fluid that flows from said fluid conduit, a first one of said two capillary sections being located at said air vent opening and a second of said two capillary sections being located at the end of said air vent tube remote therefrom.

40. A pour spout for permitting transfers from a container of fluid to a receiving vessel, the pour spout comprising:

(a) a fluid conduit attached at one end thereof to the container of fluid, said fluid conduit being provided at a location remote from the container with a fluid discharge opening through which fluid is transferred from said fluid conduit into the receiving vessel;

(b) closure means for precluding any flow of fluid from said fluid conduit until said fluid discharge opening is inside the receiving vessel;

(c) an air vent tube communicating between the exterior of said fluid conduit at a point proximate said fluid discharge opening and the interior space within said fluid conduit and the container to facilitate fluid flow from said fluid conduit; and (d) a capillary section located in said air vent tube having an inner diameter less than that of said air vent tube restricts the volume of the flow of air into said interior space to a volume less than the volume of fluid flowing from said fluid conduit reducing the pressure in said interior space to a pressure less than ambient pressure when fluid flows from said fluid conduit, whereby to effect prompt curtailment of fluid flow from said fluid conduit when the receiving vessel becomes filled with fluid.

* * * * *

UNITED STATES PATENT AND TRADEMARK OFFICE

CERTIFICATE OF CORRECTION

PATENT NO. : 4,834,151

DATED : May 30, 1989

INVENTOR(S) : Verl Law

It is certified that error appears in the above-identified patent and that said Letters Patent is hereby corrected as shown below:

Column 1, line 50, "structure" should be --structures--
Column 1, line 56, delete "in"
Column 2, line 13, "increase" should be --increases--
Column 5, line 48, "comduit" should be --conduit--
Column 5, line 54, delete "be"
Column 7, line 17, "proper" should be --prompt--
Column 7, line 52, "such" should be --actual--
Column 8, line 4, "an" should be --a--
Column 8, line 34, following "prevents" insert --the--
Column 10, line 68, after "upright" insert --position--
Column 13, line 17, before "that" insert --such--
Column 13, line 55, after "between" insert --said interior space and--
Column 18, line 23, "fulid" should be --fluid--
Column 18, line 54, "restricts" should be --, said capillary section restricting--
Column 18, line 56, following "conduit" insert --, thereby--
Column 18, line 59, delete ", whereby"

Signed and Sealed this

Twenty-fourth Day of July, 1990

*Attest:*

HARRY F. MANBECK, JR.

*Attesting Officer*

*Commissioner of Patents and Trademarks*